United States Patent [19]

Williams

[11] Patent Number: 4,811,768

[45] Date of Patent: Mar. 14, 1989

[54] UNDERARM SECURITY POUCH FOR CARRYING CASH RECEIPTS CONTAINER

[76] Inventor: Joseph P. Williams, 8085 Busey Rd., Pickerington, Ohio 43147

[21] Appl. No.: 183,561

[22] Filed: Apr. 8, 1988

[51] Int. Cl.[4] ..... A45C 1/10; A45C 13/10; A45C 13/22; A45C 13/36

[52] U.S. Cl. ..... 150/102; 150/108; 150/134; 190/101; 190/116; 224/205; 224/206; 224/258; 224/901; 383/11; 383/13; 383/28; 383/41; 383/66; 383/97; 383/18

[58] Field of Search ..... 150/102, 108, 134, 107, 150/101, 134; 224/205, 206, 258, 901; 383/11, 13, 28, 41, 66, 19, 95, 97, 18; 190/101, 102, 112, 116

[56] References Cited

U.S. PATENT DOCUMENTS

| | | | |
|---|---|---|---|
| 1,361,761 | 12/1920 | Gay | 224/206 X |
| 1,468,711 | 9/1923 | Dwyer | 150/108 X |
| 1,797,359 | 3/1931 | Meyers | 224/206 X |
| 2,210,351 | 8/1940 | Westendorf | 383/18 X |
| 2,601,465 | 6/1952 | Tatom | 383/66 X |
| 2,769,475 | 11/1956 | Fisher | 150/108 X |
| 3,674,188 | 7/1972 | Anderson | 224/205 |
| 3,739,961 | 6/1973 | Soukeras | 224/206 X |
| 4,079,767 | 3/1978 | Howard | 383/95 X |
| 4,140,164 | 2/1979 | Staup | 190/101 X |
| 4,570,688 | 2/1986 | Williams | 150/134 |

*Primary Examiner*—Sue A. Weaver
*Attorney, Agent, or Firm*—John L. Gray

[57] ABSTRACT

A security pouch of a size adapted to hold a cash receipts container in a vertical position and adapted to be worn by an individual suspended from the shoulder and adjacent the side of the individual's chest and under the individual's arm, including, an opening provided with a closure that is operable by one hand.

4 Claims, 1 Drawing Sheet

UNDERARM SECURITY POUCH FOR CARRYING CASH RECEIPTS CONTAINER

BACKGROUND OF THE INVENTION

Cash receipts containers are used by merchants to carry cash and checks to banking institutions for deposit. Typically these containers are made of plastic and are slightly larger in size than conventional United States currency and are closed on three sides and provided with a zippered opening on the fourth side which is one of the longer sides. The cash receipts containers are often carried in the open, in the hand or under the arm, on the way to the bank. Thus, these containers are frequently snatched in a robbery, an opportunity which often times may involve physical force where the individual is pushed down on the ground as the cash receipts container is forcibly removed from the individual by a robber. Since the containers are casually carried, they also occasionally are lost.

SUMMARY OF THE INVENTION

The instant invention is directed to a security pouch which is of a size and shape which may be worn underneath the arm against the side of the wearer's chest and may be used in a closed condition to hold a cash receipts container. The closure may readily be operated by one hand and the unit is adjustable to fit different sized individuals.

When the wearer has a jacket or a coat on, the security pouch and the cash receipts container therein is not open to view by the general public, yet the cash receipts container may be readily removed when the wearer wishes to make a deposit without the necessity of removing the security pouch or removing his/her outer garment.

While the security pouch is of a size and shape to be used to carry a cash receipts container in a vertical position it, of course, may be used to carry an individual's wallet or other valuables, especially when traveling.

It is therefore an object of this invention to provide a security pouch adapted to hold a cash receipts container.

It is also an object of this invention to provide a security pouch which may be completely closed when said cash container is positioned therein.

It is still a further object of this invention to provide such a security pouch which may be readily opened by the use of one hand to remove the contents without removing the outer garment or the security pouch from the wearer.

These, together with other objects and advantages of the invention will become more readily apparent to those skilled in the art when the following general statements and descriptions are read in the light of the appended drawings.

DETAILED DESCRIPTION OF THE INVENTION

Figure 1:
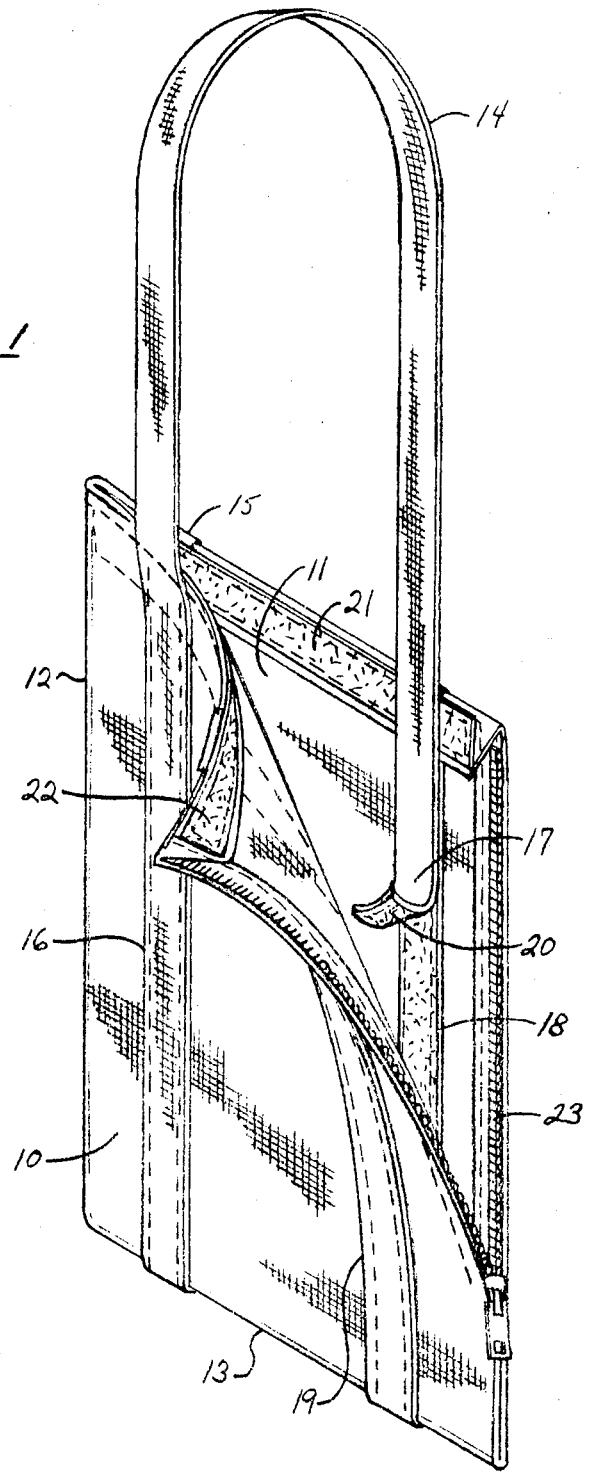
FIG. 1 is a perspective view of the security pouch of the instant invention.

Referring now more particularly to FIG. 1, the pouch contains a front panel 10 and a rear panel 11. The front and rear panels 10 and 11 are permanently secured together at edges 12 and 13. The panels 10 and 11 may be made from a single sheel of material. A strap 14 is attached to and extends along both sides of panels 10 and 11 as shown at 15 and 16. The panels 10 and 11 are preferably made from a lightweight cloth and the strap 14 is stitched to panels 10 and 11 on either side. The other end 17 of strap 15 is adapted to engage a complementary section of material 18 which is stitched to the inner side of panel 11 in a vertical direction parallel to the vertical opening between panels 10 and 11.

The security pouch is also preferably provided with a strap 19 which extends parallel to the opening space therefrom and is stitched to both panels 10 and 11 on the exterior thereof.

The side of strap 14 which engages the retaining member 18 is provided with a complementary material 20, preferably of the hook- and loop-type fastener known by the registered trademark VELCRO ®, such as U.S. Trademark Registration Nos. 1,027,417, VELCRO ®, and 1,303,907, VELCRO V ®. Therefore, the other end 17 of strap 14 may be moved vertically to a position that is comfortable for the individual wearer.

The top of panels 10 and 11 are also preferably provided with the same type of hook- and loop-type fastener as shown at 21 and 22 so that the security pouch may be secured in a closed position, or opened to permit easier access for placing the cash receipts container therein. Of course, other fasteners may be used.

A closure 23 is provided along the vertical opening of the security pouch and is preferably in the form of a zipper.

In use, the position of strap 14 is determined by the individual wearer's preference so that the security pouch fits snugly up into the armpit of the wearer. The top portions 21 and 22 may then be joined together and the zipper 23 may be closed after the cash receipts container is placed in the security pouch. The straps 15, 16, and 19 provide vertical support for the security pouch so that it remains as flat as possible and is least detectable by a would-be robber. The portion 17 of the strap 14 which may be adjusted also provides vertical internal support so that the zipper 23 may be manipulated by one hand and it is not necessary to attempt to hold the bottom of the security pouch or the top when the zipper 23 is being manipulated as is so often the custom in any use of a zipper. This is particularly important because the hand of the wearer that is on the arm on which the security pouch is located cannot easily reach the security pouch. Because of the vertical stiffening and the internal vertical support provided by the strap in its detachable adjustable mode, additional vertical support is provided so that the zipper 23 may be readily manipulated by one hand.

Since portion 17 of strap 14 is detachably secured to material 18, in the event that a thief attempts to forcibly remove the pouch from the wearer, the portion 17 of strap 14 and material 18 will part when sufficient pressure is exerted so that the person wearing the pouch will not be injured.

While this invention has been described in its preferred embodiment, it is to be appreciated that variations therefrom may be made without departing from the true scope and spirit of the invention.

I claim:

1. A security pouch of a size adapted to hold a cash receipts container in a vertical position and adapted to be worn by an individual and suspended from the shoulder of said individual and positioned adjacent the side of the individual's chest and under the individual's arm and comprising:

a flat, oblong container comprising two oppositely disposed substantially flat panels, said flat panels each having two substantially parallel longer sides connected by two substantially shorter sides, means for permanently joining one pair of said shorter sides and one pair of said longer sides together throughout their length, means for detachably securing the remaining pair of said shorter sides and the remaining pair of said longer sides of each panel to each other at the edges thereof, a strap, means connecting one end of said strap to one end of said pair of shorter sides which are detachably secured to each other at the edges thereof, the other end of said strap being detachably connected by means of hook- and loop-type fasteners to the interior of said pouch adjacent to the pair of longer sides which are detachably secured to each other for a length sufficient to permit adjustment of the useful length of said strap, and to provide support of said security pouch in normal usage, but which will permit detachment of said other end of said strap from said pouch when force is applied to the exterior of said pouch.

2. The security pouch of claim 1 wherein said flat panels have external vertical reinforcements.

3. The security pouch of claim 2 wherein said pair of shorter sides that are detachably secured to each other at the edges thereof are secured together by means of hook- and loop-type fasteners.

4. The security pouch of claim 1 wherein the remaining pair of said longer sides of each panel are detachably secured to each other by means of a zipper.

* * * * *